US007356468B2

(12) United States Patent
Webster

(10) Patent No.: US 7,356,468 B2
(45) Date of Patent: Apr. 8, 2008

(54) LEXICAL STRESS PREDICTION

(75) Inventor: Gabriel Webster, Cambridge (GB)

(73) Assignee: Toshiba Corporation, Tokyo (JP)

( * ) Notice: Subject to any disclaimer, the term of this patent is extended or adjusted under 35 U.S.C. 154(b) by 800 days.

(21) Appl. No.: 10/682,880

(22) Filed: Oct. 14, 2003

(65) Prior Publication Data

US 2004/0249629 A1 Dec. 9, 2004

(30) Foreign Application Priority Data

May 19, 2003 (GB) ..... 0311467.5

(51) Int. Cl.
*G10L 13/00* (2006.01)
*G10L 13/08* (2006.01)

(52) U.S. Cl. ..... 704/258; 704/260

(58) Field of Classification Search ..... None
See application file for complete search history.

(56) References Cited

OTHER PUBLICATIONS

Suzanne C. Urbanczyk, et al., "Assignment of Syllable Stress in a Demisyllable-Based Text-to-Speech Synthesis System", Proceedings of IEEE Pacific Rim Conference on Communications, Computers and Signal Processing, XP-010084312, Jun. 1, 1989, pp. 467-470.

M. Balestri, "A coded dictionary for stress assignment rules in Italian", CSELT Technical Report on Eurospeech 1991, vol. XX, No. 1, XP-000314306, Mar. 1992, pp. 27-30.

Kenneth Church, "Stress Assignment in Letter to Sound Rules for Speech Synthesis", 23rd Annual Meeting of the Association for Computational Linguistics, Proceedings of the Conference, XP-002268435, Jul. 8-12, 1985, pp. 246-253.

N. Pavesic, et al., "S5: The SQEL Slovene Speech Synthesis System", Proceedings of the 1999 Eurospeech Conference, XP-007001425, vol. 5, Sep. 5-9, 1999, 4 pages.

*Primary Examiner*—Tālivaldis Ivars Šmits
*Assistant Examiner*—Samuel G Neway
(74) *Attorney, Agent, or Firm*—Oblon, Spivak, McClelland, Maier & Neustadt, P.C.

(57) ABSTRACT

A system and method for predicting lexical stress is disclosed comprising a plurality of stress prediction models. In an embodiment of the invention, the stress prediction models are cascaded, i.e. one after another within the prediction system. In an embodiment of the invention, the models are cascaded in order of decreasing specificity and accuracy. There is also provided a method of generating a lexical stress prediction system. In an embodiment, the method of generation includes generating a plurality of models for use in the system. In an embodiment, the models correspond to some or all of the models described above in relation to the first aspect of the invention.

32 Claims, 10 Drawing Sheets

LEXICAL STRESS PREDICTION

The present invention relates to lexical stress prediction. In particular, the present invention relates to text-to-speech synthesis systems and software for the same.

BACKGROUND OF THE INVENTION

Speech synthesis is useful in any system where a written word is to be presented orally. It is possible to store a phonetic transcription of a number of words in a pronunciation dictionary, and play an oral representation of the phonetic transcription when the corresponding written word is recognised in the dictionary. However, such a system has a drawback in that it is only possible to output words that are held in the dictionary. Any word not in the dictionary cannot be output as no phonetic transcription is stored in such a system. While more words may be stored in the dictionary, along with their phonetic transcription, this leads to an increase in the size of the dictionary and associated phonetic transcription storage requirements. Furthermore, it is simply impossible to add all possible words to the dictionary, because the system may be presented with new words and words from foreign languages.

Therefore, it is advantageous to attempt to predict the phonetic transcription of words in the pronunciation dictionary, for two reasons. Firstly, phonetic transcription prediction will ensure that words that are not held in dictionary will receive a phonetic transcription. Secondly, words whose phonetic transcriptions are predictable can be stored in the dictionary without their corresponding transcriptions, thus reducing the size of the storage equipment requirement of the system.

One important component of the phonetic transcription of a word is the location of the word's primary lexical stress (the syllable in the word which is pronounced with the most emphasis). A method of predicting the location of lexical stress is thus an important component of predicting the phonetic transcription of a word.

Two basic approaches to lexical stress prediction currently exist. The earliest of these approaches are based entirely on manually specified rules (e.g., Church, 1985; patent U.S. Pat. No. 4,829,580; Ogden, patent U.S. Pat. No. 5,651,095), which have two principal drawbacks. Firstly, they are time consuming to create and maintain, which is especially problematic when creating rules for a new language or moving to a new phoneme set (a phoneme is the smallest phonetic unit within a language that is capable of conveying distinct meaning). Secondly, manually specified rules are generally not robust, generating poor results for words that differ significantly from those used to develop the rules, such as proper names and loanwords (words originating from a language other than that of the dictionary).

The second approach to lexical stress prediction is to use the local context around a target letter, i.e. the identities of the letters on each side of the target letter to determine the stress of the target letter, generally by some automatic technique such as decision trees or memory-based learning. This approach also has two drawbacks. Firstly, stress often cannot be determined simply on the local context (typically between 1 and 3 letters) used by these models. Secondly, decision trees and especially memory-based learning are not low-memory techniques, and thus would be difficult to adapt for use in low-memory text-to-speech systems.

It is therefore an object of the invention to provide a low memory text to speech system, and a further object of the invention to provide a method of preparing the same.

SUMMARY OF THE INVENTION

According to a first aspect of the invention, there is provided a lexical stress prediction system comprising a plurality of stress prediction models. In an embodiment of the invention, the stress prediction models are cascaded, i.e. in series one after another within the prediction system. In an embodiment of the invention, the models are cascaded in order of decreasing specificity and accuracy.

In an embodiment of the invention, the first model of the cascade is the most accurate model, which returns a prediction with a high degree of accuracy, but for only a percentage of the total number of words of a language. In an embodiment, any word not assigned lexical stress by the first model is passed to a second model, which returns a result for some further words. In an embodiment, the second model returns a result for all words in a language where a result has not been returned by the first model. In a further embodiment, any words not assigned lexical stress in the second model are passed to a third model. Any number of models may be provided in a cascade. In an embodiment, the final model in the cascade should return a prediction of stress for any word and in an embodiment the final model in the cascade should return a prediction for all words not predicted by a previous model if all words are to have a prediction on them made by the lexical stress prediction system. In this way, the lexical stress prediction system will produce a predicted stress for every possible input word.

In an embodiment, each successive model returns a result for a wider range of words than the previous model in the cascade. In an embodiment, each successive model in the cascade is less accurate than the model preceding it.

In an embodiment of the invention at least one of the models is a model to determine the stress of words in relation to an affix of the words. In an embodiment, at least one of the models comprises correlations between word affixes and the position within words of the lexical stress. In general, the affix may be a prefix, suffix or infix. The correlations may be either positive or negative correlations between affix and position. Additionally, the system returns a high percentage accuracy for certain affixes, without the need for the word to pass through every model in the system.

In an embodiment of the invention, at least one of the models in the cascade comprises correlations between the number of syllables in the word combined with various affixes, and the position of lexical stress within words. In an embodiment, secondary lexical stress is also predicted as well as primary stress of words.

In an embodiment of the invention, at least one of the models comprises correlations of orthographic affixes instead of phonetic ones. Such orthographic correlations are useful in languages where accented characters are widely used to denote the location of stress within a word, such as a final "a" in Italian, which correlates highly with word-final stress.

According to a second aspect of the invention, there is provided a method of generating a lexical stress prediction system. In an embodiment, the method of generation includes generating a plurality of models for use in the system. In an embodiment, the models correspond to some or all of the models described above in relation to the first aspect of the invention.

In an embodiment, the final model of the first embodiment is generated first, followed by generation of the penultimate model, and so on until, finally, the first model of the first embodiment is generated. By generating the models in the reverse order to that in which they are run in the system, it is possible to generate a default model, which will predict stress for all words, but with low accuracy, and then build more specialised higher models that target words that are assigned incorrect stress by the default model. By using such generation, it is possible to remove redundancy in the system, where two models in the system would otherwise return the same result. By reducing such redundancy, it is possible to reduce the memory requirements of the system, and increase the efficiency of the system.

In an embodiment of the invention, a default model, a main model and zero or more higher models are provided. In an embodiment, the default model is a simple model that can be applied to all words entered into the system and is generated simply by counting from a corpus of words where the stress point of each word falls and creating a model that simply assigns the stress point encountered most frequently during training. Such automatic generation may not be necessary; in English, the primary stress is generally on the first syllable, in Italian on the penultimate syllable etc. Therefore, a simple rule can be applied to give a basic prediction for any and all words input into the system.

In an embodiment, the main model is generated by using a training algorithm to search words and return stress position predictions for various identifiers within words. In an embodiment, the identifiers are affixes of words. In an embodiment, the correlations between the identifiers and the stress position are compared and those correlating highest are retained. In an embodiment, the percentage accuracy, minus the percentage accuracy of the combined lower level models, is used to determine the best correlations. In an embodiment, if more than one affix matches, the stress position corresponding to the affix with the highest accuracy is given the highest priority. In an embodiment, a minimum threshold on the count (the number of times an identifier predicts the correct stress over all the words of the training corpus) is included. This allows an amendable cutoff level between the number of identifier correlations included in the system that are high, but occur only rarely in the language, and correlations that are low but occur more frequently in the language.

In an embodiment of the invention, the main model contains two types of correlations: prefixes and suffixes. In an embodiment of the invention, the affixes in the main model are indexed in order of descending accuracy.

In embodiments of the invention, aspects of the invention may be carried out on a computer, processor or other digital components, such as application specific integrated circuits (ASICs) or the like. Aspects of the invention may take the form of computer readable code to instruct a computer, ASIC or the like to carry out the invention.

BRIEF DESCRIPTION OF THE DRAWINGS

Embodiments of the invention will now be described, purely by way of example, with reference to the accompanying drawings, in which.

DETAILED DESCRIPTION OF EMBODIMENTS OF THE INVENTION

A first embodiment of the invention will now be described with reference to FIGS. 1 through 3 of the drawings.

Training the System of the First Embodiment of the Invention

Figure 1:
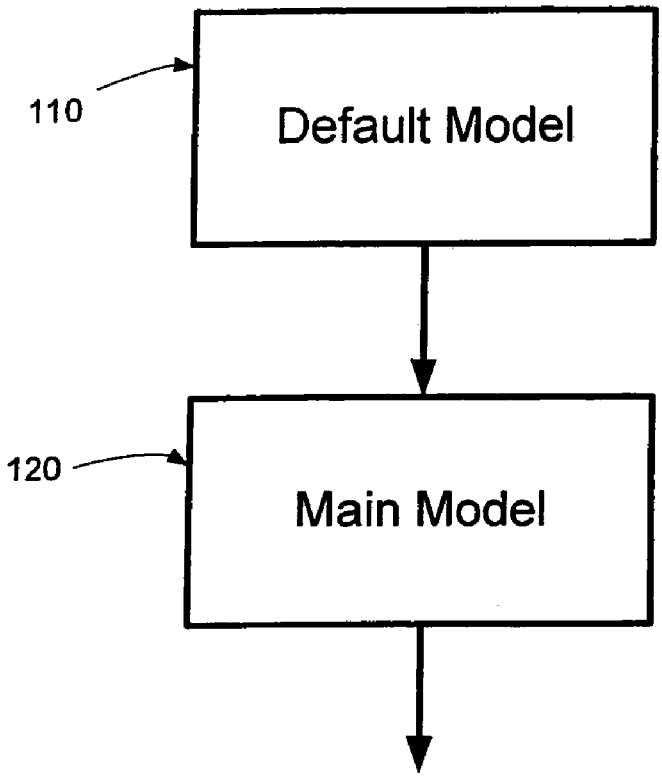
FIG. 1 shows a flow chart of the relationship between stress prediction models during training of the models in a particular language in a first embodiment of the invention.

FIG. 1 shows a cascade of prediction models of a lexical stress prediction system of the first embodiment of the invention. The cascaded models are a default model 110, and a main model 120. Each model is designed to predict the position, within a word input into the model, of the lexical stress of that word.

Training the Default Model

Figure 2:
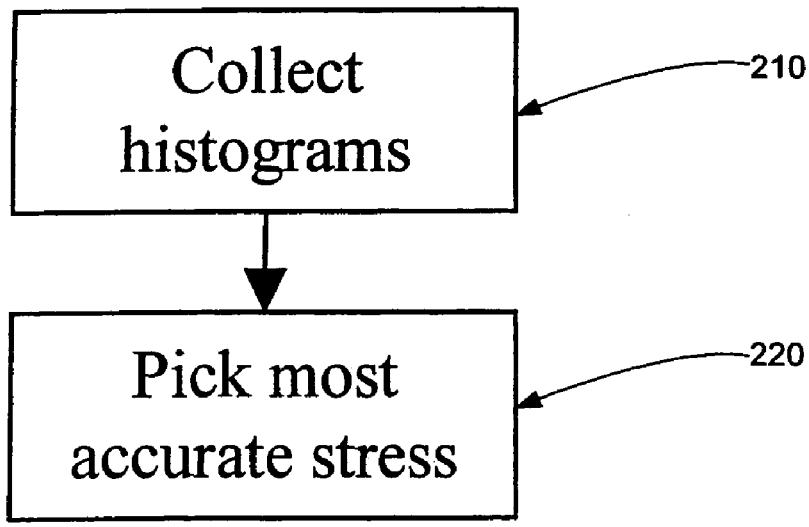
FIG. 2 shows a flow chart used for training the default model of the first embodiment of the invention.
Figure 3:
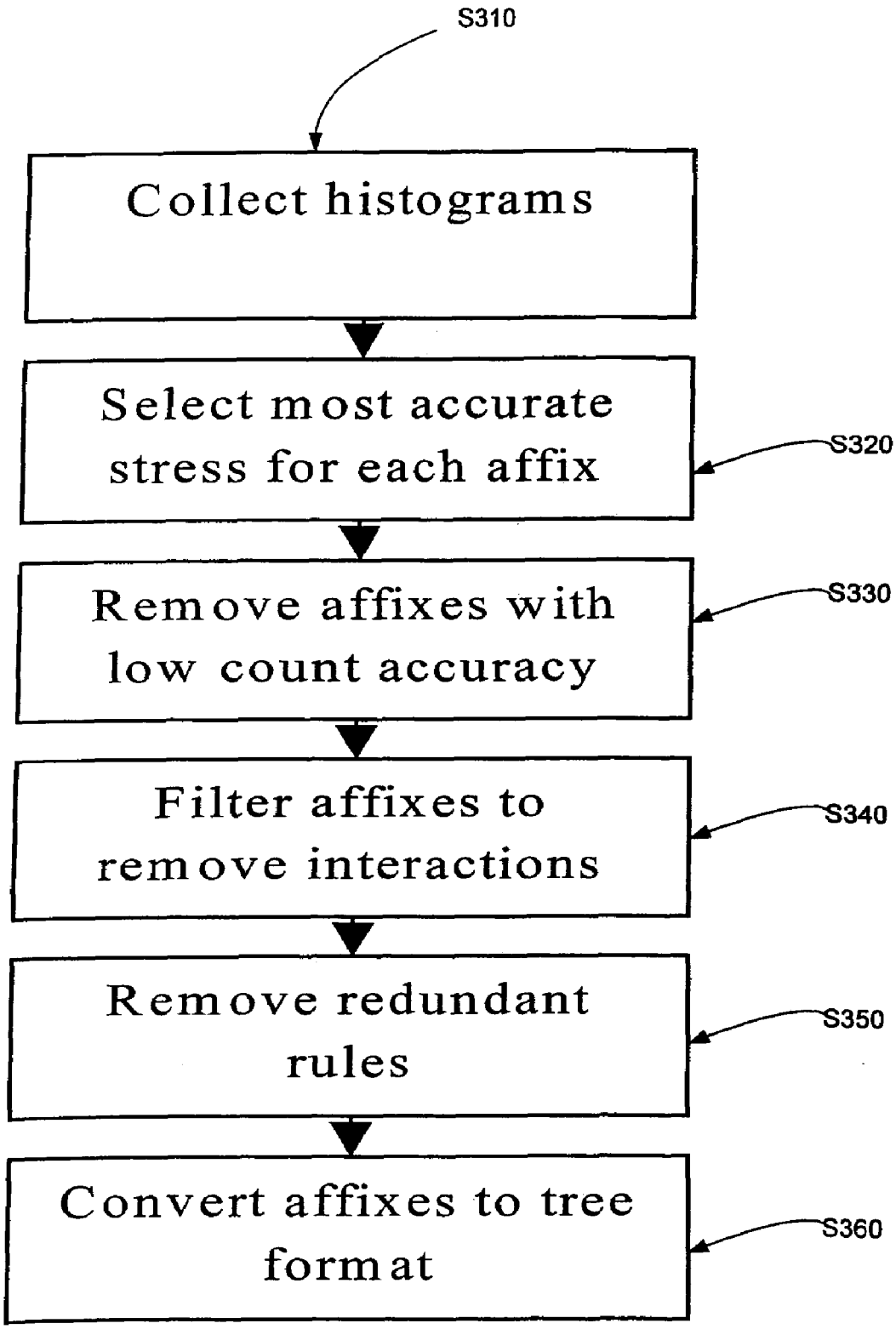
FIG. 3 shows a flow chart used for training the main model of the first embodiment of the invention.

The default model 110 is trained as shown in FIG. 2. The default model 110 is a very simple model that is guaranteed to return a prediction of the stress position for all words in a language.

The default model is generated automatically in the present embodiment by analysing a number of words in the language in which the model will function and providing a histogram of the position of the lexical stress for each word. A simple extrapolation to the entire language can then be achieved by selecting the stress position of the highest percentage of the test words and applying that stress position to the entire language. The larger the number of training words input, the more reflective of the entire language the default model 110.

Assuming, as in English or German, that over half the words of the language have the stress in a particular position (for English and German, the first syllable), this basic default model will return an accurate stress position prediction for that percentage of words in the language. In the event that the best stress position is not first syllable or last syllable, the default model also checks to make sure that the input word has enough syllables to accommodate the prediction, and if not to adjust the prediction to fit the length of the word. In many languages, automatic generation of the default model is not necessary because the most common stressed syllable is a well-known linguistic fact; as discussed above, German and English words tend to have stress on the first syllable, Italian words tend to have penultimate stress, and so on.

Training the Main Model

The main model contains two types of correlations: prefix correlations and suffix correlations. Within the model, these affixes are indexed in order of descending accuracy. If an input word pronunciation matches multiple affixes, then the primary stress correlated with more accurate affix is arranged to be returned. On implementation, if an input word pronunciation matches no affixes, then the word is passed to the next model in the cascade.

The values of primary stress that are correlated with prefixes are actually the numbers of the vowel in the word that has primary stress, as counted from the leftmost vowel in the target word pronunciation (so a stress value of '2' indicates stress on the second syllable of a word). Suffixes, on the other hand, are correlated to locations of stress that are characterised as a vowel number as counted from the rightmost vowel in the word, counting towards the beginning of the word (so a stress value of '2' indicates stress on the penultimate syllable of a word). This difference in how the location of stress is stored in correlations is due to the fact that word prefixes tend to correlate with stress relative to the beginning of words (e.g., second-syllable stress), whereas word suffixes tend to correlate with stress relative to the end of words (e.g., penultimate stress).

It is also possible to use infixes in the main model, as well as prefixes and suffixes. Infixes can be correlated with stress position, by additionally storing the position of the infix relative to the start or the end of the word, in which case, for example, a prefix of a word would have a position zero, and a suffix of a word a position equal to the number of syllables of the word.

It is also possible to make use of affixes that include phoneme class symbols rather than particular phonemes, where a phoneme class symbol matches any phoneme that is contained within a predefined phoneme class (e.g. vowel, consonant, high vowel, etc.). The stress of a particular word may be adequately defined by the position of a vowel, without knowing the exact phonetic identity of the vowel at that position in that word.

The main model is trained automatically, using a dictionary with phonetic transcriptions and primary stress as its training corpus. The basic training algorithm searches the space of possible suffixes and prefixes of word pronunciations, and finds those affixes that correlate most strongly with the position of primary stress in the words that contain those affixes. The affixes whose correlation with primary stress offer the greatest gain in accuracy over the combined lower models in the cascade are kept as members of the final stress rule. The main steps in the algorithm are generation of histograms at S310, selection of most accurate affix/stress correlations at S320, selection of the overall best affixes at S330 and S340, and elimination of redundant rules at S350.

First, at S310, histograms are generated to determine the frequency of each possible affix in the corpus and for each possible location of stress for each affix. By doing this, a correlation can be determined between each possible affix and each possible location of stress. The absolute accuracy of predicting a particular stress based on a particular affix is the frequency that the affix appears in the same word with the stress location, divided by the total frequency of the affix. However, what is actually desired is an accuracy of stress prediction relative to the accuracy of the models further on in the cascade. Therefore, for each combination of affix and stress location, the model also keeps track of how often the lower level models in the cascade (in this embodiment, the default model) would predict the correct stress.

For each affix, the best stress location is the one that offers the largest improvement in accuracy over the lower models in the cascade. In S320, the best stress location for each possible affix is picked, and those affix/stress pairs that do not improve upon the lower models in the cascade are discarded.

To maintain a low-memory model, all but the best affix/stress pairs are pruned away. In this context, the "best" pairs are those which are simultaneously highly accurate and which apply with high frequency. Generally speaking, the pairs that apply with high frequency are the ones that offer the largest raw improvements in accuracy over the lower models. However, the rules that offer the largest raw improvements in accuracy (referred to here as count accuracy) over the lower models also tend to be rules that have relatively low accuracy when calculated as a percentage of all words matched (here called percent accuracy), and this is a problem given that multiple affixes can match a single target word. As an example, take two affixes A1 and A2, where A1 is a sub-affix of A2. Assume that A1 was found 1000 times in the training corpus, and that the best stress for that affix was correct 600 times. Then, assume that A2 was found 100 times in the training corpus, and that the best stress for that affix was correct 90 times. Finally, for simplicity, assume that the default rule is always incorrect for words that match these affixes. In terms of count accuracy, A1 is much better than A2 by a score of 600 to 100. However, in terms of percent accuracy, A2 is much better than A1, by a score of 90% to 60%. Thus, A2 has a higher priority than A1, even though it applies less frequently.

However, it is not desirable to simply choose affixes based on percent accuracy, because there are an extremely large number of affixes which have a percent accuracy of 100%, but which only appear in the corpus a few times and thus have a very low count accuracy. Including a large number of these low-frequency affixes in the main model would have the effect of increasing the coverage of the model by a small amount, but increasing the size of the model by a large amount.

In the current embodiment, in order to be able to choose affixes based on percent accuracy, but to exclude affixes whose count accuracy is very small, a minimum threshold on count accuracy is established at S330. All affixes that improve upon the default model and whose count accuracy is above the threshold are chosen and assigned a priority based on percent accuracy. Varying the value of this threshold acts to change the accuracy and the size of the model: by increasing the threshold, the main model can be made smaller; conversely, by decreasing the threshold, the main model can be made increasingly accurate. In practice, somewhere on the order of a few hundred affixes provides high accuracy at a very low memory cost.

The selection of affixes must take into account the fact that pairs of affixes can interact in several ways. For example, if the prefix [t] has an accuracy of 90%, and the prefix [te] has an accuracy of 80%, then [te], having a lower priority than [t], will never be applied, since all words that match [te] also match [t]. Thus to save space, [te] can be deleted. At least two approaches can be used to eliminate such interactions at S340. The first approach is to use a greedy algorithm to choose affixes: histograms are built, the most accurate affix that improves on the default model with an above-threshold count accuracy is chosen, a new set of histograms is built which excludes all words that match any previously chosen affix, and the next affix is chosen. This process is repeated until no affix which meets the selection criteria remains. Using this approach, the resulting set of chosen affixes has no interactions. In the above example, the prefix [te] would never be chosen when using a greedy algorithm, because after choosing the more accurate prefix [t], all words beginning with [t] would be excluded from later histograms, and thus the prefix [te] would never appear.

The disadvantage of the greedy algorithm approach is that it can be quite slow when using a large training corpus. Removing interactions between affixes can instead be approximated by collecting the best affixes from a single set of histograms, and applying the two following filtering rules to remove most interactions between rules:

An affix is removed when there exists a sub-affix with a higher percent accuracy. The example of [t] and [te] above is a case where this filtering rule would apply.

For cases where a sub-affix has lower percent accuracy than an affix, the picture is slightly more complicated. In this case, if an affix, say the prefix [sa], has an accuracy of 95%, and a sub-affix, say [s], has an accuracy of 85%, then we consider that because some of the accuracy of [s] is due to words that will also match [sa], we should subtract the effects of the more accurate affix from the less accurate affix. Thus, the number correct, total number matched, and amount of improvement from the default rule of [sa] is subtracted from [s], and whether [s] still has a big enough improvement to be included in the generated stress rule is re-evaluated.

To save additional space, at S350 it is possible to eliminate a higher-ranked subset rule if a lower-ranked superset rule would predict the same stress. For example, if the prefix [dent] predicts stress 2 and has a 100% accuracy rate, and if the prefix [den] has a 90% rate and also predicts 2, then [dent] can be removed from the set of affixes.

At S360, the set of affixes that constitute the main model are straightforwardly transformed into trees (one for prefixes and one for suffixes) for quick search performance. Nodes in the tree that correspond to an existing affix contain a predicted location of primary stress and a priority number. Of all affixes that match a target word, the stress associated with the affix with the highest priority is returned. An example of such a tree is discussed below in relation to implementation of the main model.

Implementation of the System of the First Embodiment

Figure 4:
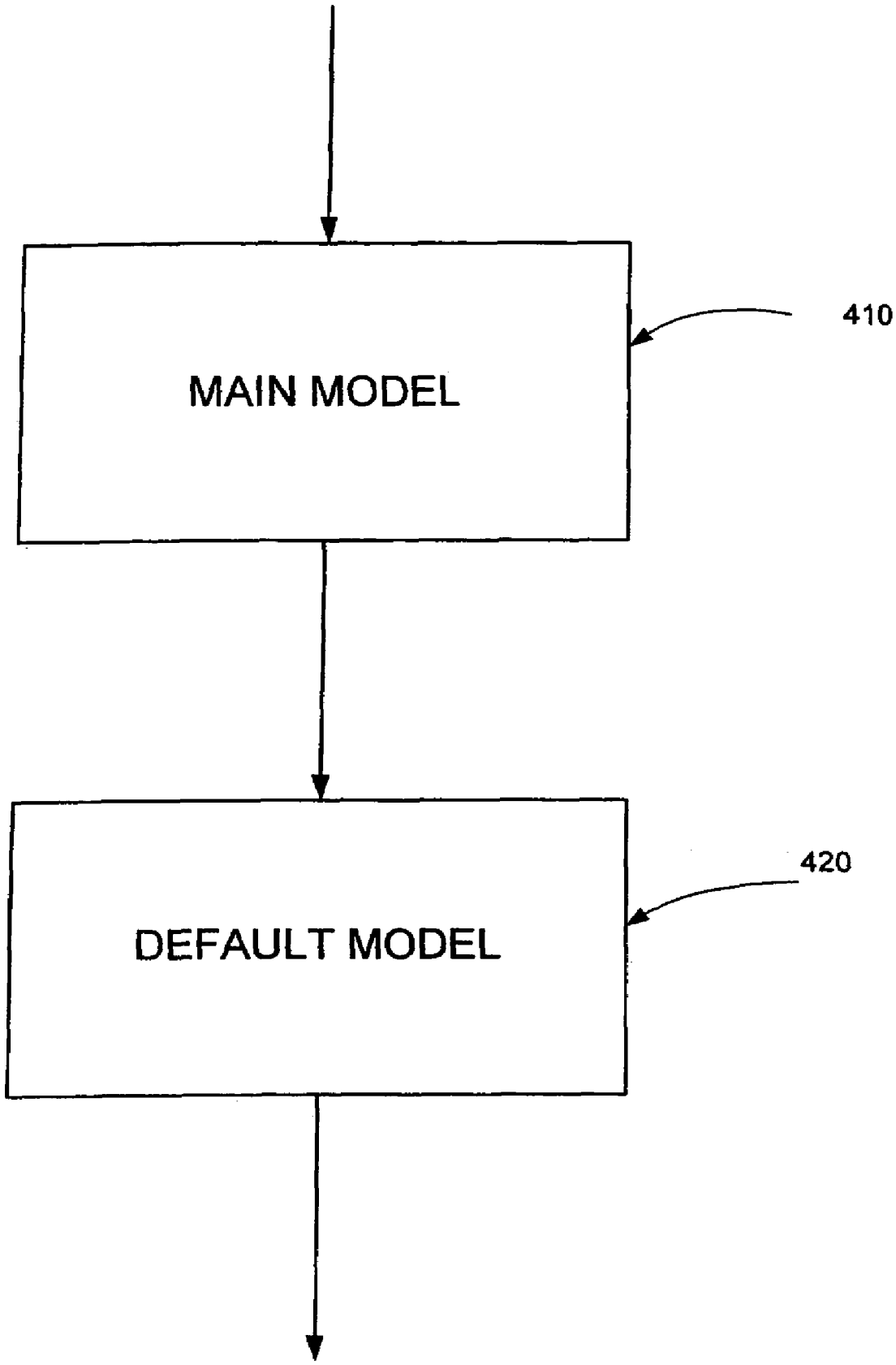
FIG. 4 shows a flow chart of the relationship between stress prediction models during implementation of the first embodiment of the invention.

FIGS. 4 and 5 show the implementation of the system of the first embodiment of the invention. On implementation, the order of the models is reversed in relation to the order in which the models were trained (discussed above), as shown in FIG. 4. In this embodiment, the main model is the model directly preceding the default model in the cascade (although this does not have to be case). Therefore, on implementation of the first embodiment, the first model into which a word to have the lexical stress predicted is passed is the main model described above. Any words for which the lexical stress is not predicted by the main model will be passed to the default model.

Implementation of the Main Model

Figure 5A:
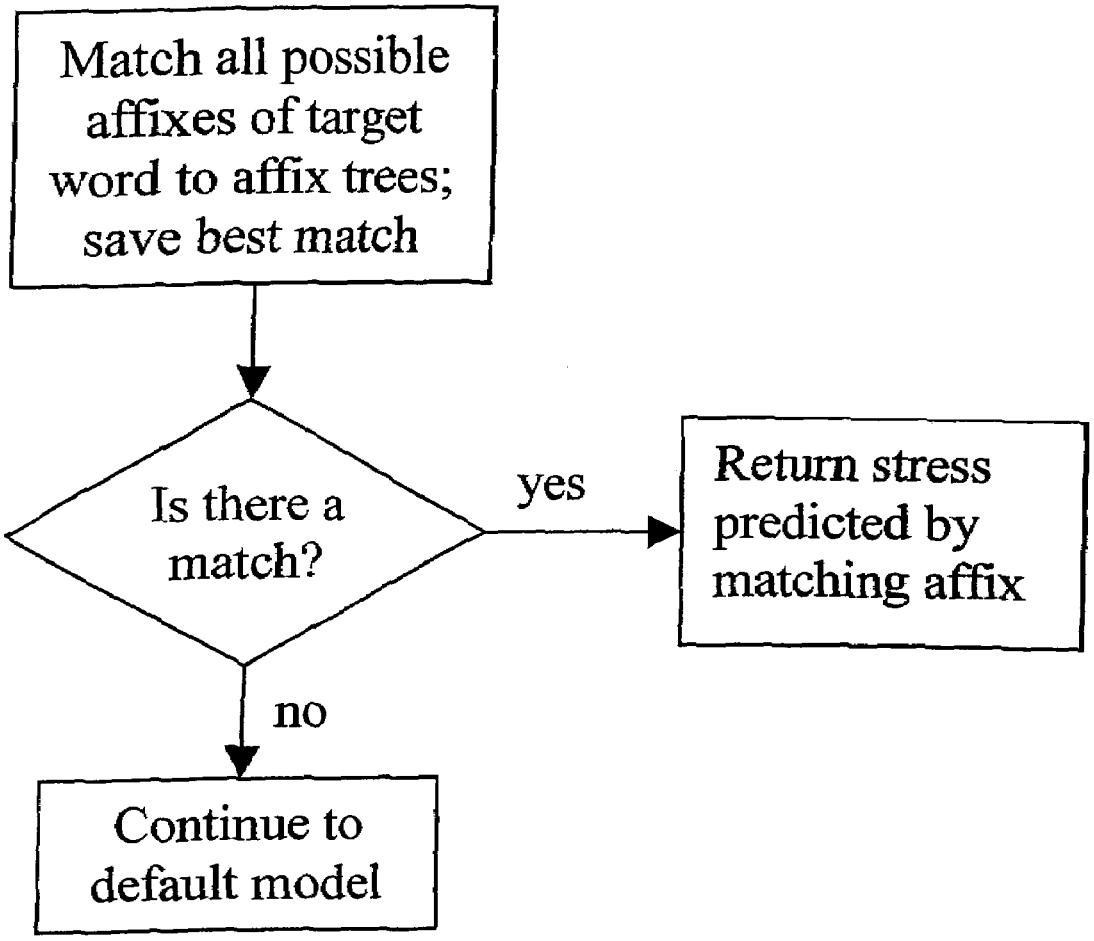
FIG. 5*a* shows a flow chart of the implementation of the main model of the first embodiment of the invention.

FIG. 5*a* shows a very high level flow chart for implementation of the main model. As can be seen, if a word is matched within the main model, the stress position is output. However, if no stress position can be found in the main model for the particular word in question, the word is output from the main model to the default model, with no stress prediction being made by the main model.

Figure 5B:
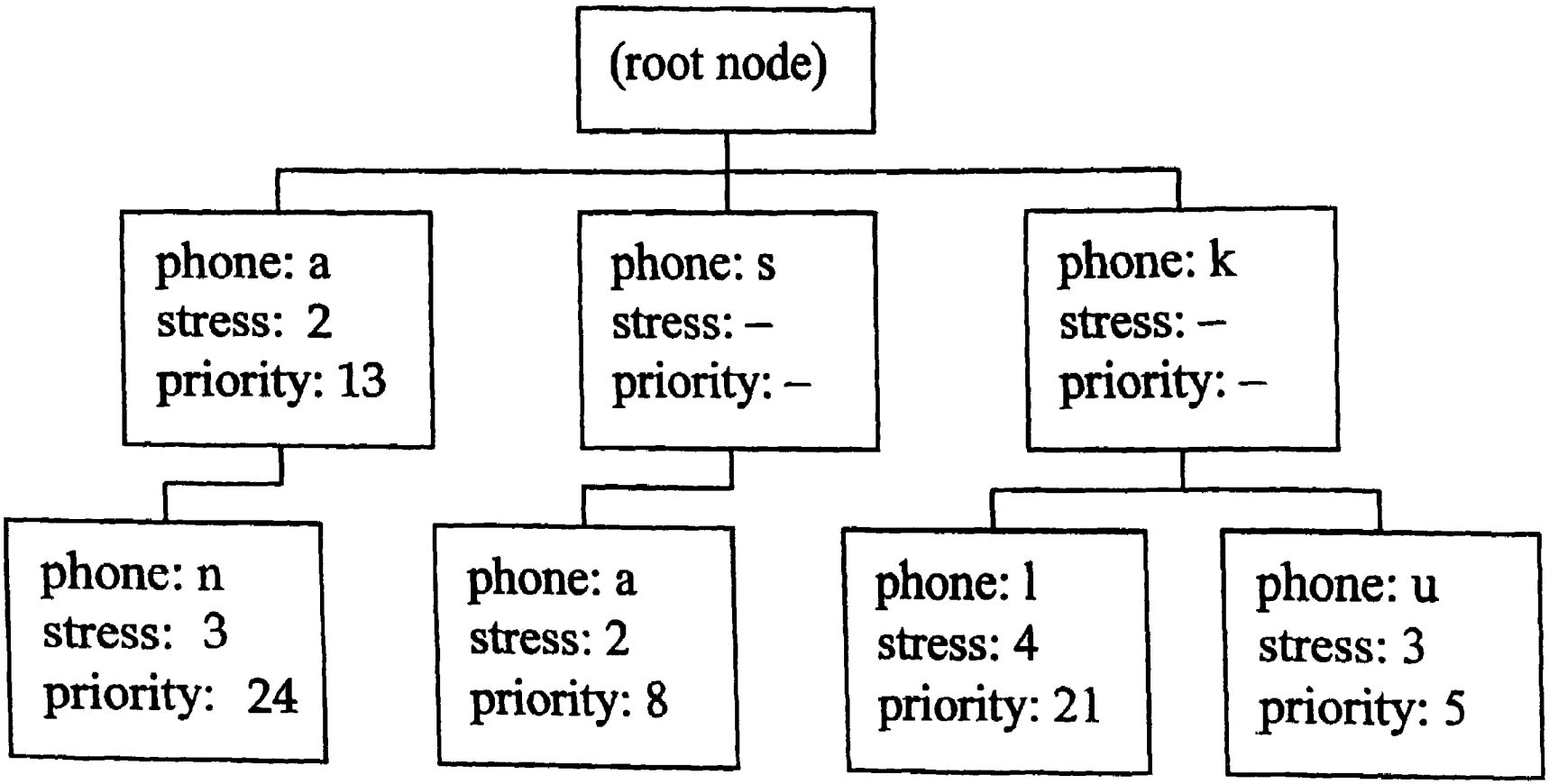
FIG. 5*b* shows a tree used in implementation of the main model for a series of specific phonemes.

FIG. 5*b* shows an example of part of a tree used in implementing the main model. The prefixes/stresses/priorities represented in this example tree are ([a], [an], [sa], [kl], and [ku]).

An example of how the tree functions will now be given. The target word [soko] would not match anything, because although the first phone [s] is in the tree as a daughter of the root node, that node does not contain stress/priority information, and is therefore not one of the affixes represented in the tree. However, the target word [sako] would match, because the first phone [s] is in the tree as a daughter of the root node, the second phone [a] is in the tree as a daughter of the first phone, and that node has stress and priority information. Thus for the word [sako], stress 2 would be returned. Next the target word [anata], which matches two prefixes in the tree, is considered. The prefix [a-] corresponds to a stress prediction of 2 in the tree, while the prefix [an-] corresponds to a stress prediction of 3. However, because of the priority index, when multiple prefixes are matched by a single word, the stress associated with the highest priority match (which corresponds to the most accurate affix/stress correlation) is returned. In this case, the priority of prefix [an-] is 24, which is higher than the priority of 13 of [a-], so the stress associated with [an-] is returned, resulting in a stress prediction of 3.

Figure 5C:
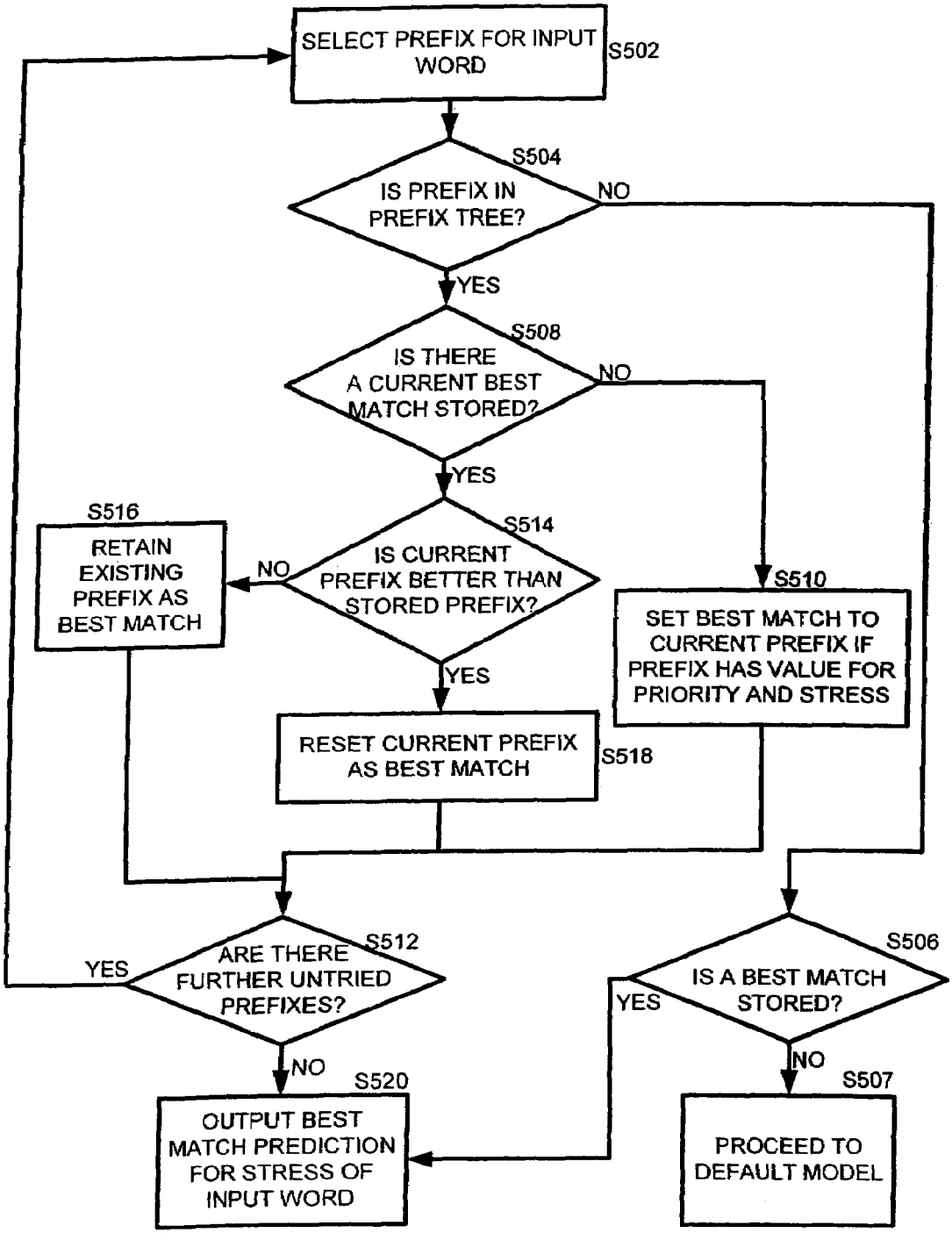
FIG. 5*c* shows a further flow chart of the implementation of the main model of the first embodiment of the invention.

FIG. 5*c* shows a more detailed flow chart for implementation of the main model. The flow chart shows how the system of the present embodiment decides which is the best match for the various prefixes within the model for a given word. At S502 the first prefix is selected. In the present embodiment, the first phone of the target word is chosen. If there is no such prefix in the tree in the first iteration of the loop, for example, in the tree of FIG. 5*b* prefix [u-], then because no best match information is stored (S507), as this is the first iteration of the loop, the main model does not contain a prediction and the word is passed to the next model in the sequence, which in this embodiment is the default model, at S507.

If the first phone is in the prefix tree, then if there is no priority and stress information, because on the first iteration of the loop there will be no pre-stored prefix information, the system will proceed to the next prefix at S512. This would be the case in the tree of FIG. 5*b* for the word [soko] discussed above. If the prefix has stress and priority information, the data relating to priority and stress position for that phone is stored at S510, as there will not yet be a current best match (as it is the first time round the loop). The information stored for the example of FIG. 5*b* would be the information for [a-]. The system then looks to see if there are further, untried, prefixes in the word at S512. The next prefix is then selected in the next iteration of the loop at the repeat of S502.

If the further prefix is not held in the prefix tree at S504 on the second iteration, if a best match is stored (S506), this is output. In the example above, this would occur for the word [akata], because [a-] is stored, but [ak-] is not. If no best match is already stored (S506), the system proceeds to the default model at S507.

If, on the second loop a further prefix is held in the prefix tree, at S508 the system checks whether a best match is currently stored. If no best match is found, the system checks whether the further prefix has priority information stored. If there is none, the system moves on to try further prefixes (at S512). If, on the other hand, a best match is stored, the system (at S514) checks whether this prefix information is of higher priority than the already stored information. If the already stored prefix information is of higher priority than the current information, the stored information is retained at S516. If the current information is of higher priority than the previously stored information, then the information is replaced at S518. If another prefix exists in the target word, the loop repeats, otherwise, the stress prediction stored is output.

The model then repeats the process of FIG. 5*c* for a separate tree of suffixes, rather than prefixes. As a final step, the relative priorities of the best prediction from prefixes and of suffixes are compared and the highest overall priority stress prediction is output.

Figure 5D:
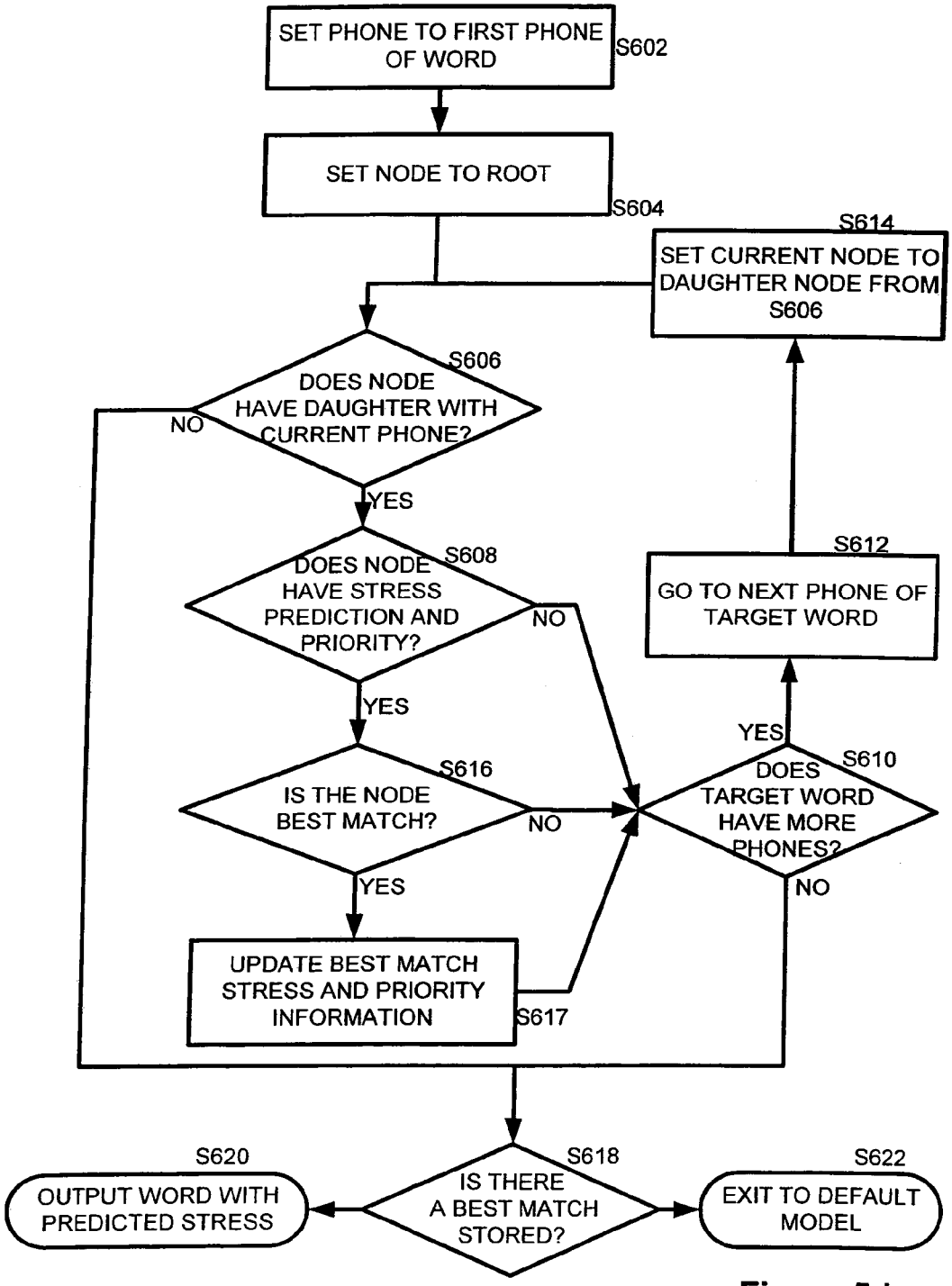
FIG. 5*d* shows a further flow chart of the implementation of the main model of the first embodiment of the invention.

FIG. 5*d* shows a further, more detailed, flow chart for implementation of the main model. The figure shows the operation of the main model as a whole. At S602 the phone to be analysed by the system is set to be the first phone of the target word i.e. the current prefix is the first phone of the target word. At S604 the node of the prefix tree is set to "root", i.e. the highest node in the prefix tree of FIG. 5*b*. At S606 the system checks whether the node has a daughter with the current phone. In the example of FIG. 5*b*, this will be "yes" for [a-], [s-] and [k-], and "no" for all other phones. If the node does not have a daughter node in the tree with current phone, the system proceeds direct to the default model.

If there is a daughter node with the current phone then at S608 the system checks whether this has stress prediction and priority. If it does not, as in the case for [s-] in the example above, the system checks if there are more unchecked phones within the word at S610, and, if so, the system changes the current phone to the next phone in the word (which corresponds to changing the current prefix to the previous prefix plus the next phone of the target word) at S612, and moves to the daughter node of the prefix tree identified in S606 at S614. If there are no further unchecked phones, at S618 the system outputs the best stress found so far, if there is any at S620, proceeds to the default model at S622 if no best stress can be found.

If the daughter node has stress prediction and priority, at S616, as with [a-] in the example, the system checks whether the node is a best match, as described in S508, S514, S516 and S518 of FIG. 5*c* above. If it is a best match the system stores the predicted stress at S617. If it is not a best match the system continues to S610 and repeats as described above until the process ends with output of a predicted stress or proceeding to the default model.

As stated above, the procedure is then repeated for the suffixes of the word, and the best match out of the prefixes and suffixes is output as the stress prediction for the word. It would be possible to proceed using only prefixes, or only suffixes, rather than the combination of the two in embodiments of the invention.

A second embodiment of the invention will now be discussed with reference to FIGS. 6 and 7 of the drawings.

Figure 6:
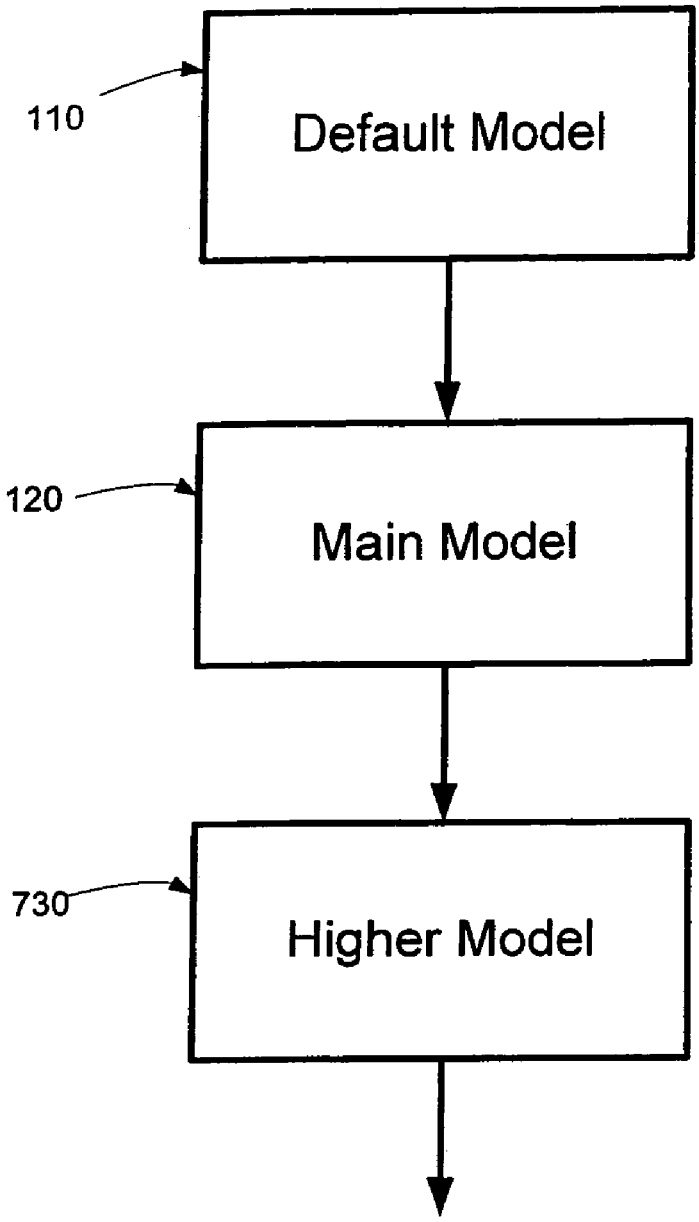
FIG. 6 shows a flow chart of training the system of a second embodiment of the invention.
Figure 7A:
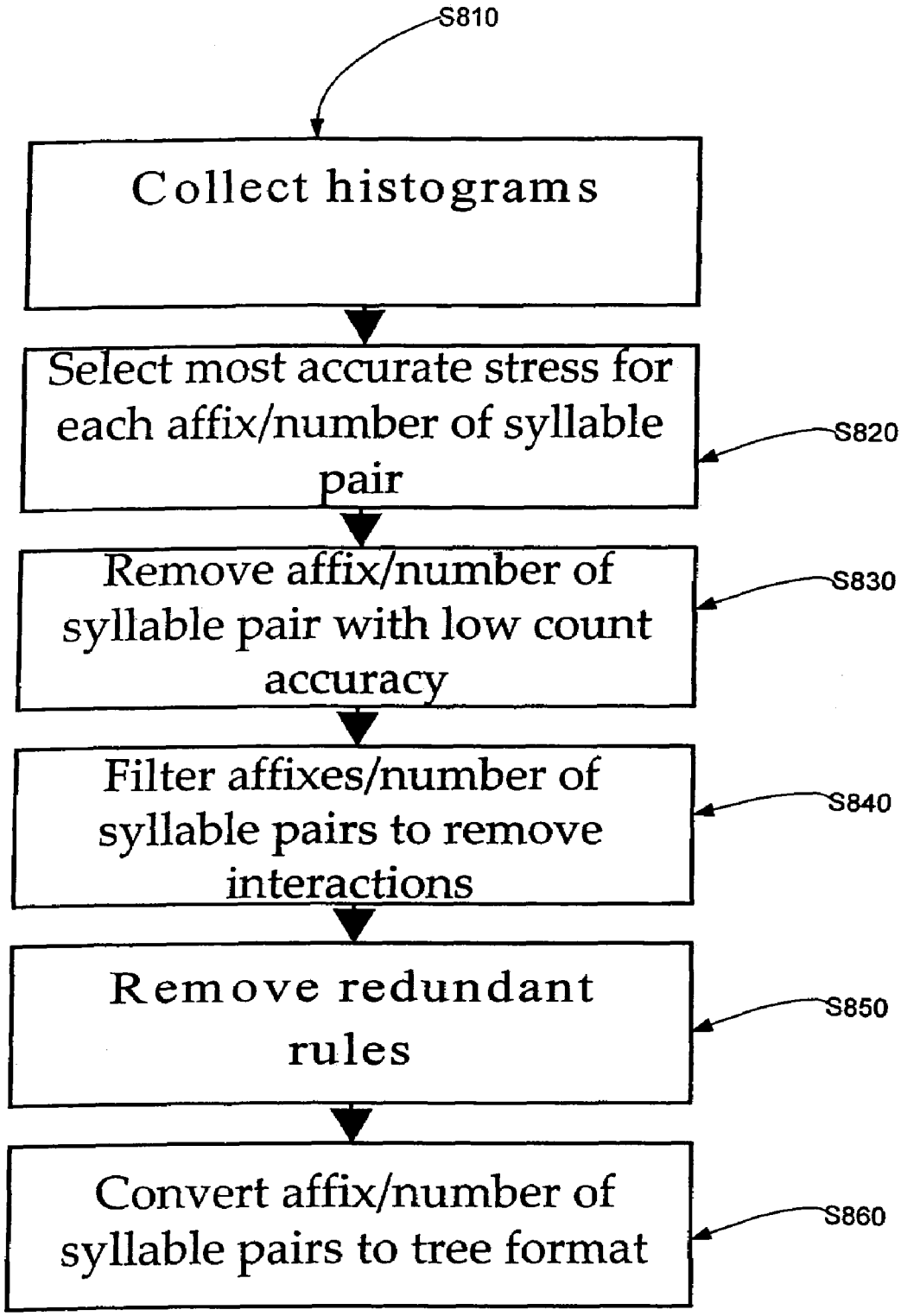
FIG. 7*a* shows a flow chart used for training a higher model of the second embodiment of the invention.

FIG. 6 shows an over-view of training of the second model. In the second embodiment, the default model and main model are the same as described in the first embodiment. However, a higher level model is also included in the system. The higher level is trained after the main model. In this embodiment, the higher model is trained in a similar way to the main model. The difference between the method of training the main model and the higher model is in what the histograms are counting. In the main model, there is one histogram bin for each combination of affix and stressed syllable. The higher model also takes into account the number of syllables in words. The best affix for a word with a given number of syllables is then determined, rather than just the affix-stress position data. FIG. 7*a* shows the training steps of the higher model. The difference is to replace "affix" from FIG. 3 with an "affix/number of syllables pair". This higher model is implemented in the same manner as shown in relation to FIGS. 5*c* and 5*d* discussed above.

Figure 7B:
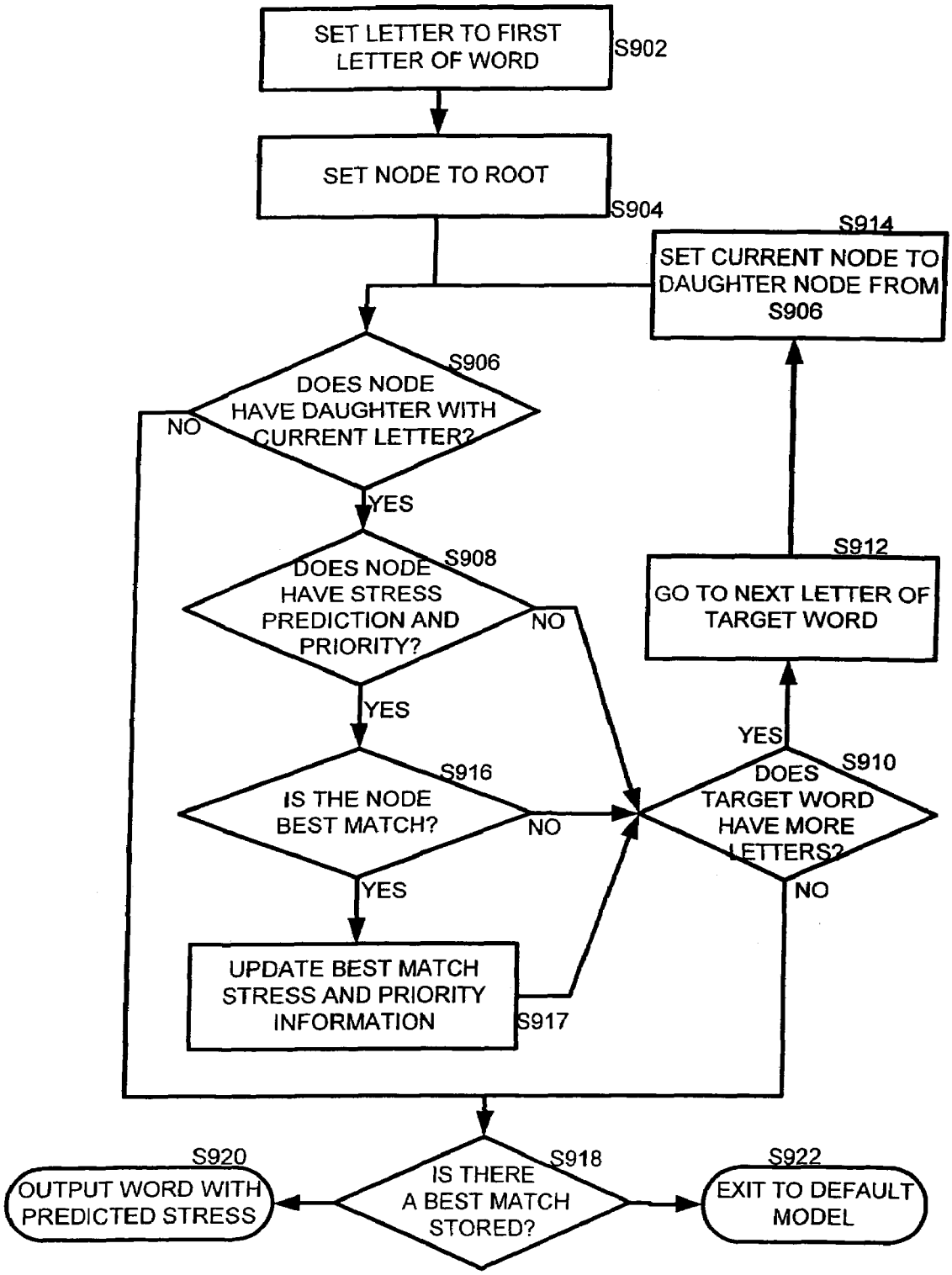
FIG. 7*b* shows a flow chart of the implementation of the system of the second embodiment of the invention.

FIG. 7*b* shows implementation of a further higher model, which may be used in the system instead of or as well as the higher model shown in FIG. 7*a*. In this higher model, orthographic rather than phonetic affixes are used. For example, in an orthographic prefix model the word "car" with pronunciation [k aa] has two orthographic prefixes [c-] and [ca], but only one phonetic prefix [k-]. The training of the orthographic higher model is the same as for the main model, but making use of orthographic rather than phonetic prefixes, the steps being the same as those of FIG. 3. Similarly, the implementation of the orthographic model is the same as the main model described above, with orthographic prefixes (letters) being used instead of phonetic prefixes (phones). The implementation shown in FIG. 5*d* is equally appropriate, with the replacement of "phone" with "letter", as shown in FIG. 7*b*.

In a variation on the main and or higher models discussed above, infixes can be used as well as or instead of one or both of prefixes and suffixes. In order to make use of infixes, the distance from the right or left edge of the word (in number of phones or number of vowels) is specified, in addition to the phonetic content of the infix. In this model, prefixes and suffixes would just be special cases where the distance from the edge of the word is 0. The rest of the algorithms for training and implementation remains the same. When training the model, accuracy and frequency statistics are collected, and when you look for affix matches during prediction, each affix would be represented as a triplet (right or left edge of word; distance from edge of word; phone sequence), rather than just (prefix/suffix; phone sequence). The same is also possible, by analogy, for orthographic affixes, simply by replacing phonetic units with orthographic ones, as described above.

In a further embodiment of the invention, once the primary stress of the word in question has been predicted and assigned, the above embodiments can be used again to predict the secondary stress of a word. Therefore the system predicting primary and secondary stress would comprise two cascades of models. The cascade for secondary stress would be trained in the same way as for primary stress, except the histograms would collect data for secondary stress. The implementation would be the same as for primary stress, as described in the embodiments above, except that trees produced for secondary stress would be used to predict the secondary stress position, rather than trees for primary stress.

In a yet further embodiment of the invention, one or models within the system can also be used to identify negative correlations between an identifier within a word and the associated stress. In this case, the negative correlation model would be the first model in the system on implementation, and the last during training, and would place constraints on the models further down the system. This higher model makes use of negative correlations between affixes (and possibly other features) and stress. This class of models requires a modification to the operation of the cascade of models as described previously. When a target word is matched in a negative correlation model, no value is returned immediately. Rather, the associated syllable number is tagged as unstressable. If there remains only one stressable vowel in the target word, the syllable of that vowel is returned; otherwise, the search continues, with the caveat that if any later match is associated with a stress location that corresponds to an unstressable vowel in the target word, that match is ignored.

The methods and systems described above may be implemented in computer readable code for allowing a computer to carry out embodiments of the invention. In all of the embodiments described above, the words and stress predictions of said words may be represented by data interpretable by the computer readable code for carrying out the invention.

The present invention has been described above purely by way of example, and modifications can be made within the spirit of the invention. The invention has been described with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognise that these functional building blocks can be implemented by discrete components, application specific integrated circuits, processors executing appropriate software and the like or any combination thereof.

The invention also consists in any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the claims, abstract and drawings may be replaced by alternative features serving the same, equivalent or similar purposes, unless expressly stated otherwise.

Any discussion of the prior art throughout the specification is not an admission that such prior art is widely known or forms part of the common general knowledge in the field.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. A lexical stress prediction system for receiving data representing at least part of a word and outputting data representing the position of lexical stress of the word, the system comprising a plurality of stress prediction model means for finding matches between model data and received data, the plurality of model means comprising:

a first model means for receiving the received data and searching for a match between the generated model data and the received data, and if a match for the received data is found, outputting prediction data representative of a prediction of lexical stress corresponding to the received data; and a default model means for receiving the received data if no match is found in any other of the plurality of model means, and outputting prediction data representative of a prediction of lexical stress corresponding to the received data, wherein the first model means is an automatically generated first model means which is trained automatically using a dictionary with phonetic transcriptions and primary stress as a training corpus by searching the words of the dictionary for possible affixes and determining the affixes which correlate with the position of primary stress in the words, the first model data comprising affixes stored with stress and priority information the system being configured such that when more than one match is found by the first model means of the received data the prediction data output corresponds to the lexical stress prediction with the highest priority.

2. A lexical stress prediction system according to claim 1, wherein the model means of the system are arranged to predict lexical stress position within said at least part of a word by identifying at least one lexical identifier within said at least part of a word.

3. A lexical stress prediction system according to claim 1, wherein the first stress prediction model means is for outputting prediction data representing a stress prediction for a percentage of words of a given language, that percentage being less than 100, and passing remaining unmatched received data on to a subsequent model means in the plurality of models.

4. A lexical stress prediction system according to claim 1, wherein the default model means is for receiving received data representing at least parts of words for which a stress prediction has not been made by any of the other of the plurality of stress prediction model means, and outputting prediction data representing a stress prediction for any such at least parts of words received.

5. A lexical stress prediction system according to claim 4, wherein the first model means has a more accurate prediction of the lexical stress of words output from it than the accuracy of the default stress prediction model means.

6. A lexical stress prediction system according to claim 3, further comprising a further stress prediction model means between the first model means and the default model means for receiving the received data if no match is found between the received data and the model data in the first model means and searching for a match between the further model data and the received data, and if a match for the received data is found, outputting prediction data representative of a prediction of lexical stress corresponding to the received data.

7. A lexical stress prediction system according to claim 1, wherein the model means with the lowest percentage return for lexical stress prediction is the most accurate model means for stress prediction of at least parts of words returned by it.

8. A lexical stress prediction system according to claim 1, wherein the default model means of the system has the lowest specificity and accuracy and each preceding model means has a higher specificity and accuracy than the one directly after it.

9. A lexical stress prediction system according to claim 1, wherein the data representative of at least part of said word is representative of phonetic information of said at least part of said word.

10. A lexical stress prediction system according to claim 1, wherein the data representative of at least part of a word is representative of letters of said at least part of said word.

11. A lexical stress prediction system according to claim 1 further comprising a further model means, for predicting negative correlation between a particular at least part of a word and the position of lexical stress within it.

12. A lexical stress prediction system according to claim 1, further comprising a further lexical stress prediction system for predicting secondary lexical stress of said at least part of said word.

13. A lexical stress prediction system according to claim 2, wherein affixes are used as the lexical identifiers.

14. A method of predicting lexical stress of words comprising:

receiving data representative of at least part of a word;

passing the data through a lexical stress prediction system comprising a plurality of stress prediction model means, wherein passing the received data through the stress prediction system comprises:

passing the received data through a first model means containing model prediction data;

searching the first model means for a match between the model prediction data and the received data; and if a match for the received data is found in the first model means, outputting prediction data representative of a prediction of lexical stress corresponding to the received data, and if no match for the received data is found in any other of the plurality of model means, passing the received data through a default model means, where a lexical stress prediction is given for the data, and outputting prediction data representative of a prediction of lexical stress corresponding to the received data, the first model means being trained automatically using a dictionary with phonetic transcriptions and primary stress as a training corpus by searching the words of the dictionary for possible affixes and determining the affixes which correlate with the position of primary stress in the words, the generated model prediction data comprising affixes stored with stress and priority information, wherein when more than one match is found by the first model means of the received data, the prediction data output corresponds to the lexical stress prediction with the highest priority.

15. A method of predicting lexical stress according to claim 14, wherein the first model means predicts lexical stress for a percentage of words, the percentage being less than 100.

16. A method of predicting lexical stress according to claim 14, further comprising, after passing the data through the first model means, if no match is found in the first model means, passing the data through a further model means;

searching the further model means for a match of the received data with further model prediction data; and if a match for the received data is found in the further model means, outputting prediction data representative of a prediction of lexical stress corresponding to the received data, and if no match for the received data is found in the further model means, passing the received data to the default model means.

17. A method of predicting lexical stress according to claim 16, wherein the further model means comprises data representing priority information, and, if more than one match for the received data is found in the further model means, prediction data representing the lexical stress with the highest priority is output.

18. A method according to claim 16, wherein the further model means predicts lexical stress for a percentage of at least parts of words, the percentage being higher than the prediction percentage of the first model means.

19. A method according to claim 14, wherein a match is found in a model means when data representing a particular lexical identifier is found in the received data representing said at least part of a word.

20. A method according to claim 14, wherein if a match for the data is found in the first model means, the lexical stress position in the received data is identified and marked with data representing an identifier, which is passed to the further model means, identifying a particular lexical position as unstressable, and further model means do not predict the identified lexical stress.

21. A method according to claim 20, wherein the lexical identifier is an affix of said at least part of a word.

22. A method of generating a lexical stress prediction system, the method comprising generating a plurality of lexical stress prediction model means, wherein generation of the plurality of model means comprises:

generating a default model means for receiving data representing at least part of a word and outputting prediction data representing a prediction of lexical stress of said any at least parts of words; and then generating a first model means for receiving data representing said at least part of said word and outputting prediction data representing a prediction of lexical stress of some of said at least parts of words, wherein the first model means is generated automatically using a dictionary with phonetic transcriptions and primary stress as a training corpus by searching the words of the dictionary for possible affixes and determining the affixes which correlate with the position of primary stress in the words, the generated data comprising affixes stored with stress and priority information and wherein when more than one match is found by the first model means of the received data, the prediction data output corresponds to the lexical stress prediction with the highest priority.

23. A method of generating a lexical stress prediction system as claimed in claim 22, wherein the default model means is generated by setting the lexical stress position to be returned by the default model means to be a predetermined position.

24. A method of generating a lexical stress prediction system as claimed in claim 23, wherein the predetermined position is generated by determining a highest frequency lexical stress position from a selection of at least parts of words.

25. A method of generating a lexical stress prediction system according to claim 22, wherein the default model means generated has the lowest accuracy and specificity of the plurality of model means.

26. A method of generating a lexical stress prediction system according to claim 22, wherein the default model means is generated such that it will return a stress prediction result for any data representative of at least part of any word input into it.

27. A method of generating a lexical stress prediction system according; to claim 22, wherein the first model means is generated by searching data representing a number of words and returning data representing stress position predictions for at least one lexical identifier within said number of words.

28. A method of generating a lexical stress prediction system according to claim 27, wherein the first model means is generated such that where two or more matches are found for a particular lexical identifier, a priority is assigned to each, the priority being dependent on the percentage accuracy of the match.

29. A method of generating a lexical stress prediction system according to claim 28, wherein the first model means is generated such that where two matches are found for a particular lexical identifier, the match with the highest priority will be returned.

30. A method of generating a lexical stress prediction system according to claim 27, wherein the lexical identifier is an affix.

31. A method of generating a lexical stress prediction system according to claim 30, wherein the affix is chosen from the group comprising: phonetic prefix, phonetic suffix, phonetic infix, orthographic prefix, orthographic suffix and orthographic; infix.

32. A lexical stress prediction system generated by the lexical stress prediction generation method of claim 22.

* * * * *